United States Patent [19]

Vidal

[11] Patent Number: 5,033,912

[45] Date of Patent: Jul. 23, 1991

[54] EARTH STABILIZATION

[75] Inventor: Henri Vidal, Neuilly-sur-Seine, France

[73] Assignee: Societe Civile des Brevets de Henri Vidal, Puteaux Cedex, France

[21] Appl. No.: 399,455

[22] PCT Filed: Jan. 6, 1989

[86] PCT No.: PCT/GB89/00006

§ 371 Date: Oct. 24, 1989

§ 102(e) Date: Oct. 24, 1989

[87] PCT Pub. No.: WO89/06296

PCT Pub. Date: Jul. 13, 1989

[30] Foreign Application Priority Data

Jan. 7, 1988 [GB] United Kingdom ..... 8800309

[51] Int. Cl.[5] ..... E02D 5/20

[52] U.S. Cl. ..... 405/262; 405/258; 405/284

[58] Field of Search ..... 405/262, 258, 273, 284–286

[56] References Cited

U.S. PATENT DOCUMENTS

| | | | |
|---|---|---|---|
| 1,472,917 | 11/1923 | Laird | 405/273 |
| 2,149,957 | 3/1939 | Dawson | 405/273 |
| 3,464,211 | 9/1969 | Andresen | 405/262 |
| 4,116,010 | 9/1978 | Vidal | 405/262 |
| 4,710,062 | 12/1987 | Vidal et al. | 405/262 |

FOREIGN PATENT DOCUMENTS

| | | | |
|---|---|---|---|
| 0130949 | 11/1985 | European Pat. Off. . | |
| 2233857 | 1/1975 | France | 405/262 |
| 2303121 | 10/1976 | France . | |
| 381815 | 10/1932 | United Kingdom | 405/262 |
| B1069361 | 5/1967 | United Kingdom . | |
| 2014221A | 8/1979 | United Kingdom . | |

OTHER PUBLICATIONS

Japanese publication entitled "Foundation Practice", pp. 13, 16, 63, 105, 107, 116, Jul., 1988.

"Soil Reinforcement", *Civil Engineering*, vol. 839, No. 10, Oct. 1979, pp. 47–53.

"Reinforced Earth-application & development", *Civil Engineering*, vol. 839, Nov./Dec. 1985, pp. 53–57.

*Primary Examiner*—Dennis L. Taylor

*Attorney, Agent, or Firm*—Burns, Doane, Swecker & Mathis

[57] ABSTRACT

A stabilized earth structure includes a front face and a plurality of layers of reinforcements that extend rearwardly from the front face. Individual layers of compacted earth are disposed between the layers of reinforcements. The frictional force that is mobilized between the layers of reinforcements and the earth in the rear one-third of the length of the reinforcements is greater than that mobilized by the front one-third of the length of the reinforcements. The frictional forces mobilized by the reinforcements create a tension in the reinforcements which is sufficient to stabilize the active zone of the earth structure while also being less than the tensile strength and pull-out resistance of the reinforcements.

9 Claims, 1 Drawing Sheet

EARTH STABILIZATION

FIELD OF THE INVENTION

This invention concerns improvements in or and more particularly, this invention relates to reinforcements relating to reinforcements for use in stabilized earth structures.

BACKGROUND OF THE INVENTION

The technique of stabilizing earth structures by incorporation of spaced flexible reinforcements in the earth mass has become well-established. The basic principles of this procedure were set out in British Patent No. 1039361 of Henri Vidal and a large number of structures of this kind have been build all over the world. The reinforcements stabilize the mass virtually completely by frictional forces, both between the reinforcements and the adjacent fill particles and between those particles and the remainder of the fill. The reinforcements are so spaced that such frictional forces are transmitted throughout the fill and tension generated in the reinforcements opposes significant horizontal movement of the fill particles.

The tensile strength of the reinforcements must be sufficient to withstand the horizontal forces generated by the weight of the fill and any loads placed thereon, such as a road and road traffic. In order to retain the elastic properties of the stabilized earth structure, it is necessary that any modified form of the reinforcement should be flexible, in order to retain frictional contact with the fill and accommodate earth movements. It has been found that an earth mass stabilized in this way can be built with vertical sides up to substantial heights and the earth behaves as a material having predetermined elastic properties capable of accommodating significant vertical settling movements without failure.

An unstabilized block of earth has a tendency to fail in the well known way first described by Coulomb along a plane from the foot of the block at an angle of $\alpha=\pi/4+\phi/2$ (where $\phi$ is the angle of friction), normally about 63° to the horizontal. The mass of earth above this plane is often termed the "Coulomb wedge" or "active wedge". In older techniques, where a vertical wall was required, this was provided by a relatively massive wall structure at the vertical face resisting overturning primarily by its weight. Using the techniques of British Patent No. 1069361, the vertical sides of the earth block merely need protection from erosion and are commonly provided with relatively thin cladding elements attached to the exposed ends of the reinforcements.

The reinforcements used in the technique of British Patent 1069361 are, most efficiently, strips but differently shaped reinforcements are possible provided they are capable of mobilizing frictional forces adequate to stabilize the mass. The strips or other reinforcements are generally incorporated in the fill in layers, the structure normally being built up by placing a layer of spaced strips on a flat compacted layer of earth, compacting a further layer of fill on top of the strips and placing a further layer of strips, this procedure being continued until the structure has reached the required height.

It is found that the presence of the reinforcements according to the Vidal technique changes the properties of the earth mass to the extent that the boundary of the active wedge is substantially nearer to the vertical face of the mass than in the case of unreinforced earth. Recent experiments have shown that, surprisingly, the position of the boundary of the active wedge, which is, in fact, the line of maximum tension in the reinforcements, runs almost parallel to the vertical face, except for the region near the foot of the structure. Thus it has been found that the boundary of the active zone lies, for the greater part of the structure, at a distance about 0.28 H (±0.02 H) from the face (where H is the height of the structure).

In such a structure, the reinforcements have always had a length of at least 0.7 H which means that a length of reinforcement of at least 0.4 H extended beyond the active wedge into the resisting zone, i.e. the zone not liable to failure. In low or medium height walls, the length of the reinforcements is normally greater relative to height, e.g. 0.7 to 1.2 H, so that in such cases even more of the reinforcement lies in the resisting zone and simply serves to mobilize sufficient friction in the earth mass to resist movement of the stabilized active wedge. The surface area of reinforcement in contact with the fill is calculated to ensure that the reinforcements cannot be pulled out. Substantial safety factors are always applied, however, and it has not been previously appreciated how little of the length of the reinforcements lay in the active wedge.

The reinforcements have always been designed to present a substantially uniform frictional surface over their length. Typically these have been strips of stainless or galvanized steel, sometimes provided with transverse bars to increase frictional contact. When it is appreciated that only 0.3 H of the length of the reinforcement is required to stabilize the active wedge and the remainder, amounting to 0.4 H or more, functions simply to retain the reinforcement in the zone behind the active wedge, the retaining zone, it becomes possible to consider alternative ways of retaining the rearward parts of the reinforcements in the retaining zone which might result in savings of materials and hence costs. It will be appreciated that the length of the reinforcements contributes significantly to the cost of the structure both in terms of the material of the reinforcements and also the depth of fill which has to be moved and compacted to construct the wall.

It is believed that in any stablised earth structure, the flexible reinforcements should extend to a distance of least 0.45 H, preferably at least 0.5 H, in order maintain the desired characteristics of the mass except near the toe of the structure, where this could be reduced to 0.35 H or, more preferably, 0.4 H. Beyond a distance of 0.8 H however, it is now believed that frictional contact with the fill is unnecessary even in low walls.

As indicated above, previous designs have used reinforcements of length 0.7 H or greater and having uniform characteristics along their length. It has now been found possible to use shorter reinforcements, for example having a length of 0.65 H or less, more preferably about 0.5 H, provided the reinforcements are designed to ensure their retention in the retaining zone. It is thus possible to provide in the active zone, only sufficient frictional contact between the reinforcements and the earth to stabilize the active zone (with applied safety factors) while designing the rearward section of the reinforcements to resist pulling out of the retaining zone. This can be achieved by abandoning the concept of using reinforcements having uniform properties over their whole length and designing them with a stabilizing zone and a retaining zone having different frictional characteristics.

The point of maximum tension in such reinforcements will in general lie at a distance about 0.3 H from the front end. However, since the reinforcements will, in general, be designed to be used in building walls of various heights, the position of this point will vary according to the intended use. Nevertheless, it can be stated as a generalization that this point will normally lie in the central ⅓ of the length of the reinforcement. In considering the different frictional properties of the reinforcement on either side of the point of maximum tension it is therefore convenient to consider only the portions of the reinforcement on either side of this central section.

OBJECTS AND SUMMARY OF THE INVENTION

According the present invention, therefore, there is provided a flexible reinforcement for earth stabilization having a front end to be placed at or near the front surface of a stabilized earth mass and a rear end to be situated at the rear of said mass, said reinforcement having greater frictional interaction with earth at the rear than at the front such that the frictional force which can be mobilized under standard constraint by the rear ⅓ of the reinforcement is greater that that which can be mobilized by the front ⅓ thereof, said reinforcement having substantially no means other than friction for interaction with earth.

In this way, the reinforcements can be shorter from front to rear than conventional reinforcements, thereby saving on the material used for the reinforcements (commonly steel) and/or on the volume of fill handled in building the wall.

Another way of stating the above frictional requirement is that the product of the coefficient of friction of the reinforcement with earth times the area of both sides of the section of reinforcement concerned (hereafter called the "frictional capacity") of the rear ⅔ of the reinforcement is greater than that of the front ⅔. The ratio of the frictional capacity of the rear ⅔ to the front ⅔ is preferably at least 1.33, but advantageously not greater than 4.0.

While the reinforcement can be any of the types suitable for use in the Vidal technique, it is preferably a strip. The material of the reinforcement may also vary. High tension metals are preferred, e.g. steel; however, suitable precautions must be taken against corrosion, e.g. by galvanization or other coating means.

If desired, the strip can carry ribs which increase its frictional interaction, as in British Patent 1563317.

The differences in frictional capacity between the front and rear sections of the reinforcement can in part be achieved by differences in surface profile (as in the above ribbed strip) but will principally be achieved by increasing the area of the rear ⅔. Thus, in one embodiment of the invention, a reinforcement can consist of a front section consisting of a single length of strip which will in general be over ⅔ the length of the reinforcement, joined to two lengths of strip at a single junction i.e. a Y configuration. If the junction is at the mid point, the length of strip material used is about 1½ times that of a straight strip of the same length from the front to rear. On the other hand the latter strip would have half the frictional capacity in the rearward retaining section and a second such strip would have to be used to provide as much resistance to pull-out forces as a Y - reinforcement according to the invention. There is thus a net saving of steel of about 25%.

Alternatively, one can compare the new Y reinforcement with a longer single strip having the same area and hence the same pull out resistance. This will be 50% longer and thus require 50% more fill to be handled in building the wall.

It will be appreciated that the same advantages apply to other reinforcements according to the invention which are invariably shorter than conventional uniform reinforcements having the same pull-out resistance.

A further possibility is simply to construct the rear section of the reinforcement of wider strip material i.e. .to join a narrower front section of strip to a wider rear section.

According to a further feature of the invention there is provided a stabilized earth structure having a substantially vertical front face and comprising layers of substantially horizontal reinforcements extending from the said front face rearwards, layers of compacted earth being between said layers of reinforcements, the frictional force mobilized between the reinforcements and the earth in the rear ⅓ of the length of said reinforcements being greater than that mobilized by the front ⅓ thereof, the frictional forces mobilized by the reinforcements creating a tension therein which is sufficient to stabilize the active zone of the structure while being less than the tensile strength and pull-out resistance of the reinforcements.

It will be appreciated that in such a structure, the reinforcements may be shorter than conventional uniform reinforcements having the same frictional capacity per unit length as the front ⅓ section of the reinforcements used according to the invention, provided the same number of reinforcements is sued in each case. As indicated above, this can result in a considerable saving in the amount of fill handled and, in many cases, the volume of earth excavated to accommodate the wall.

In general the line of maximum tension-in the reinforcements in such a structure will be in substantially the same position as in a conventional Vidal structure i.e. at about 0.3 H.

The invention is particularly applicable to low or medium height walls for example form 4 to 15 meters in height or for the upper 15 meter sections of high walls. Over that range, the ratio of the length of the reinforcements L to the height of the wall H is conventionally from 1.3 to 0.7. It is found that, in a structure according to the invention, L/H can be significantly reduced. On the other hand, it is necessary to consider the function of the stabilized earth wall as a gravity wall which must resist overturning forces. In general L/H should not be reduced below 0.45, preferably not below 0.50. While, in theory, the number of reinforcements can be varied infinitely, in practice any stabilized earth construction system will use standard panels having uniform appearance and possessing a limited number of points for attachment of reinforcements. This leads to a tendency for lower walls actually to have a greater ratio L/H than higher walls. In such cases L/H, in systems according to the invention, may well be higher than 0.5; in general, however, L/H will not be above 0.8. In some cases L/H may not be the same throughout the structure but will be less for reinforcements near the toe, e.g. as low as 0.4 or even 0.35, provided the stability of the structure is maintained.

In general, in order to ensure adequate frictional interaction in the active zone, it is desireable that in this zone, at least 2%, and preferably at least 5% of the area of the bed of earth on which each layer of reinforcements is laid is covered by the material of the reinforcements and that there are at least 4 such layers in the structure.

BRIEF DESCRIPTION OF THE DRAWINGS

The invention is now described by way of illustration only with reference to the accompanying drawings in which.

DETAILED DESCRIPTION OF THE PREFERRED EMBODIMENTS

Figure 1:
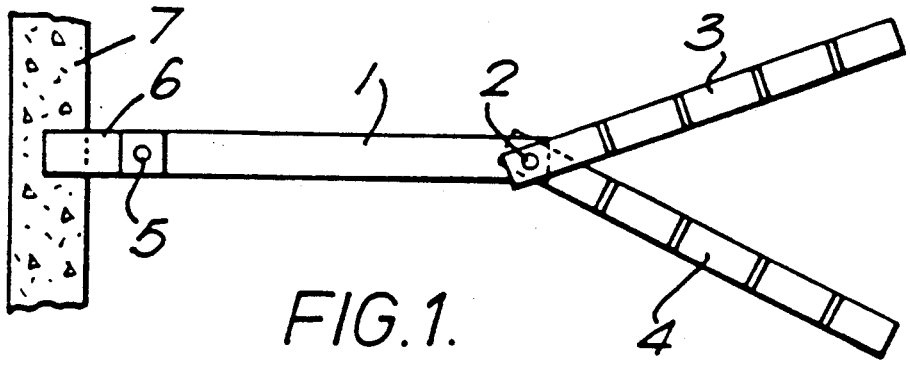
FIG. 1 shows in plan view one embodiment of a reinforcement according to the invention.

In the reinforcement shown in FIG. 1, the front section 1, consisting of 60×5 mm plain galvanized steel strip, is jointed by a bolt 2 to two sections 3 and 4 of 60×5 mm ribbed high adherence strip (also galvanized steel). The front end of the reinforcement is secured by a further bolt 5 to the tab 6 embedded in a concrete facing unit 7.

If the reinforcements form part of a 10.5 meter wall, L/H can be 0.5 and the point of maximum tension will be at about 0.3×10.5 meters i.e. at about 3 meters. The plain section 1 should therefore, in such a structure, be 3 meters in length. The two sections 3 and 4 may be 2.5 meters in length. In terms of pull-out resistance, this is equivalent to two ribbed high adherence strips having the same length of strip rearward of the point of maximum tension i.e. 2.5 meters. The total length of 2 such strips would thus be 2×5.5 meters. The saving in steel which may be achieved is thus of the order of one third. Alternatively, it can be seen that the strip according to the invention is equivalent to a single ribbed high adherence strip having the same length of strip rearward of the point of maximum tension as the two 2.5 meter lengths shown in FIG. 1, the total length of such a strip thus being 3+2×2.5=8 meters. This would require the depth of fill to be increased by 2.5 meters with considerable increase in overall cost.

Figure 2:
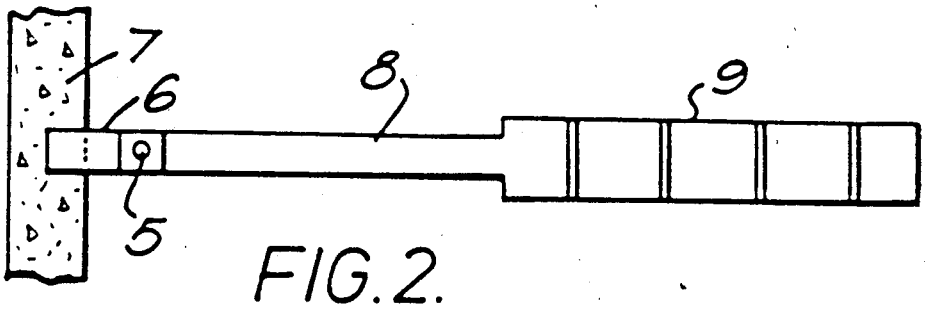
FIG. 2 shows a further embodiment of a reinforcement according to the invention.

In the reinforcement shown in FIG. 2, the integral front section 8 consists of 3 meters of 60×5 mm plain strip which is integral with a rear section 9 consisting of 120×5 mm strip carrying transverse ribs to increase adherence. In performance it is thus similar to the embodiment of FIG. 1.

Figure 3:
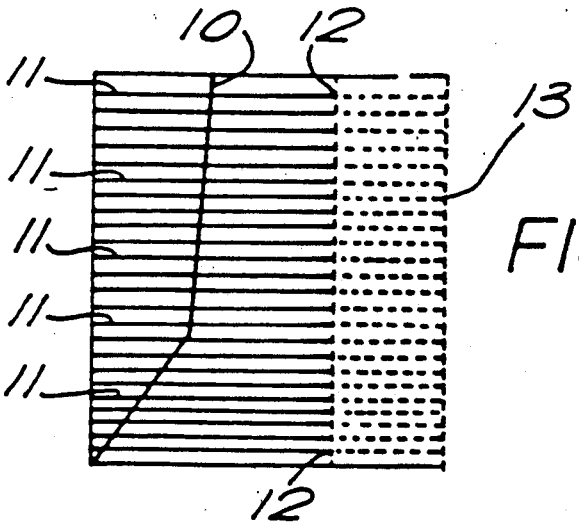
FIG. 3 shows in diagrammatic section a stabilized earth structure according to the invention.

In the wall shown in FIG. 3, the line 10 joins points of maximum friction in the reinforcements 11 according to the invention. The ends of the reinforcements 12 define the rear of the wall. The line 13 shows the position of the ends of conventional reinforcements of the same material as the front sections of the reinforcements according to the invention (used in the same numbers and spacing). The line of maximum tension 10 is approximately the same in both cases.

What is claimed is:

1. A stabilized earth structure having a front face and an active zone and comprising: layers of substantially horizontal reinforcements extending rearwardly form said front face and layers of compacted earth disposed between said layers of reinforcements, said reinforcements being capable of flexing to accommodate earth settlement movement and to remain in frictional contact with the earth during such movements, said reinforcements including means for mobilizing a frictional force between the reinforcements and the earth in the rear ⅓ of the length of said reinforcements that is greater than the frictional force mobilized between the reinforcements and the earth in the front ⅓ of the length of said reinforcement so that the frictional forces mobilized by the reinforcements create a tension in the reinforcements which is sufficient to stabilize the active zone of the structure while being less than the tensile strength and pull-out resistance of the reinforcements, said means for mobilizing a frictional force including the rear ⅓ of the length of said reinforcements having a plan area which is greater than the plan area of the front ⅓ of the length of said reinforcements, the length of the reinforcements being L and the height of the structure being H, and L/H being equal to or less than 0.65.

2. A stabilized earth structure as claimed in claim 1, wherein said means includes each of said reinforcements having a front section defined by a single strip and a rear section defined by two strips, said two strips being joined to said single strip at a single junction to define Y-shaped reinforcements.

3. A stabilized earth structure as claimed in claim 1, wherein said means includes each of said reinforcements having a rear section formed of a wider strip of material than the front section.

4. A stabilized earth structure as claimed in claim 2, wherein the length of the front section is greater than ⅓ the length of the reinforcement.

5. A stabilized earth structure as claimed in claim 3, wherein the length of the front section is greater than ⅓ the length of the reinforcement.

6. A stabilized earth structure as claimed in claim 1, wherein the height of the structure is between about 4 and 15 meters.

7. A stabilized earth structure as claimed in claim 1, wherein in the active zone of the structure, at least 2% of the area of the earth on which each layer of reinforcements is laid is covered by the material of the reinforcements, and wherein in the structure includes at least four layers of reinforcements.

8. A flexible reinforcement for use in a stabilized earth structure as claimed in claim 1, the reinforcement comprising a front section consisting of a single length of strip joined to two lengths of strip at a single junction to define a "Y" configuration.

9. A flexible reinforcement for use in a stabilized earth structure as claimed in claim 1, the reinforcement comprising a rear section formed of wider strip material than that forming a narrower front section.

* * * * *